United States Patent [19]

Dartnall

[11] Patent Number: 4,762,474

[45] Date of Patent: Aug. 9, 1988

[54] PUMP HAVING RECIPROCATING PIPE AND SLIDABLY SUPPORTED HOLLOW BODY

[76] Inventor: William J. Dartnall, 15 Alness Street, Applecross, Western Australia, Australia

[21] Appl. No.: 835,111

[22] PCT Filed: Jun. 11, 1985

[86] PCT No.: PCT/AU85/00127

§ 371 Date: Feb. 11, 1986

§ 102(e) Date: Feb. 11, 1986

[87] PCT Pub. No.: WO86/00116

PCT Pub. Date: Jan. 3, 1986

[30] Foreign Application Priority Data

Jun. 12, 1984 [AU] Australia ..... PG5469
Jan. 22, 1985 [AU] Australia ..... PG8986

[51] Int. Cl.[4] ..... F04B 19/02; F04B 7/04; F04B 21/04

[52] U.S. Cl. ..... 417/469; 417/509; 417/547; 417/550; 417/552; 417/554; 92/162 R

[58] Field of Search ..... 417/545, 547, 550, 552, 417/554, 510, 460, 466, 469, 443, 457, 509; 92/162 R

[56] References Cited

U.S. PATENT DOCUMENTS

| | | | |
|---|---|---|---|
| 530,350 | 12/1894 | Rosenkranz | 417/554 X |
| 1,043,568 | 11/1912 | Campbell | 417/466 |
| 1,097,955 | 5/1914 | Walinder | 417/509 |
| 2,141,957 | 12/1938 | McDaniel | 417/509 |
| 2,178,822 | 11/1939 | Upton et al. | 417/554 |
| 2,261,468 | 11/1941 | Hartner | 417/509 |
| 3,578,886 | 5/1971 | Nino | 417/509 X |
| 4,173,451 | 11/1979 | Moore, Jr. | 417/469 X |

FOREIGN PATENT DOCUMENTS

| | | | |
|---|---|---|---|
| 11160 | 7/1928 | Australia . | |
| 145259 | 2/1952 | Australia | 417/552 |
| 957606 | 8/1949 | France . | |
| 1531502 | 5/1968 | France . | |
| 243788 | 12/1926 | United Kingdom . | |
| 567068 | 1/1945 | United Kingdom | 417/552 |

*Primary Examiner*—Leonard E. Smith
*Assistant Examiner*—Paul F. Neils
*Attorney, Agent, or Firm*—Harness, Dickey & Pierce

[57] ABSTRACT

A bore hole pump which eliminates the need for a piston sealingly engaging with the walls of the pump body. The pump comprises a hollow body closed at its lower end by a non-return inlet valve and slidably and sealingly supporting at its upper end, via a seal, a reciprocating riser pipe which is likewise closed at its lower end by a non-return valve. Upward movement of the riser pipe causes fluid to be drawn into the pump body via inlet valve whilst downward movement of the riser pipe causes fluid to be expelled from the pump body via outlet valve.

13 Claims, 6 Drawing Sheets

PUMP HAVING RECIPROCATING PIPE AND SLIDABLY SUPPORTED HOLLOW BODY

This invention relates to pumps.

Conventional pumps generally comprise a pumping cylinder which accommodates a piston whereby on relative reciprocation between the cylinder and the piston, fluid is drawn into one end of the cylinder through an inlet and then is transferred to the other side of the piston to pass from the other end of the cylinder.

One disadvantage of piston pumps is that it is generally more difficult to produce a smooth cylindrical interior surface than a smooth cylindrical exterior surface. This is particularly the case in the tube manufacture. Therefore the production of a smooth bored cylinder for a piston pump usually requires special machining of that surface.

In addition during the pumping action of the piston pump with the movement of the piston towards one or the other end there is usually an increase in sealing pressure between the piston seal and cylinder wall. This increase in pressure tends to increase the frictional contact between the piston seal and the cylinder and since the circumference of the cylinder bore is usually maximized to maximise the pumping volume of the pump the frictional forces so produced can be relatively large.

A further disadvantage of piston pumps particularly pumps used in bore holes arises from the fact that the fluid being pumped generally carries with it abrasive and/or corrosive materials which cause abrasion of the cylinder bore and the piston seal on reciprocation of the piston within the cylinder due to the intimate contact between the piston seal and the fluid being pumped. It is also common for solid abrasive particles to become lodged between the piston body and the bore adjacent the seal to provide a source of considerable abrasive action.

As a result of the frictional contact between the seal and the cylinder bore the resultant abrasion of that seal and cylinder bore during the use of the pump is common for there to be some leakage, although minimal, past the piston during usage and after usage of the pump. In most cases the leakage past the piston during usage can be tolerated however if such leakage occurs when the pump is not in use the fluid which lies above the piston will drain away from the riser pipe and cylinder. When the pump is used again it is necessary to prime the pump and/or there is some delay betwen the initiating of the pumping action to the delivery of the first fluid from the outlet of the pump. The necessity to prime the pump before usage is of considerable disadvantage due to the need to maintain a supply of fluid to effect priming of the pump. The delay in delivery of the fluid is also of a disadvantage where the pump being used by a drive source which is variable in its operation such as a solar powered drive or a wind powered drive where the energy source which effects the drive will vary in its incidence.

It is an object of this invention to provide a pump which eliminates the need for a piston sealingly engaged with the walls of a cylinder.

In one form the invention resides in a pump having a hollow body having an inlet controlled by a first nonreturn valve which permits the entry of fluid into the body, said pump being characterised by a pipe, one end of which extends into the hollow body, said pipe being slidably recieved within said body, a seal being located between the hollow body and the pipe, a second nonreturn valve within said pipe to permit the entry of fluid from within the body to the pipe past the second nonreturn valve, and a drive means to cause relative reciprocation between the pipe and the body.

The invention will be more fully understood in the light of the following description of several specific embodiments. The description is made with reference to the accompanying drawings of which:

FIG. 1 comprises a schematic sectional elevation of a pump according to the first embodiment during the upstroke portion of the pump cycle;

FIG. 2 comprises a schematic sectional elevation of the pump according to the embodiment during the downstroke of the pump cycle;

Figure 1:
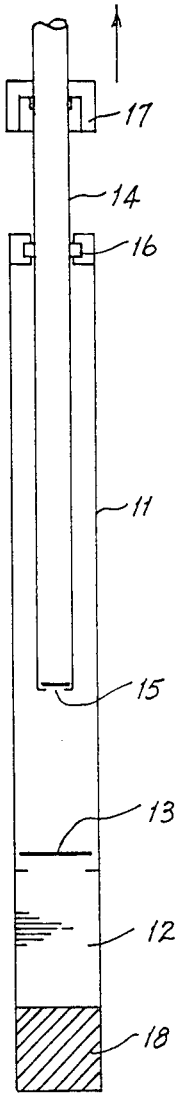
Figure 2:
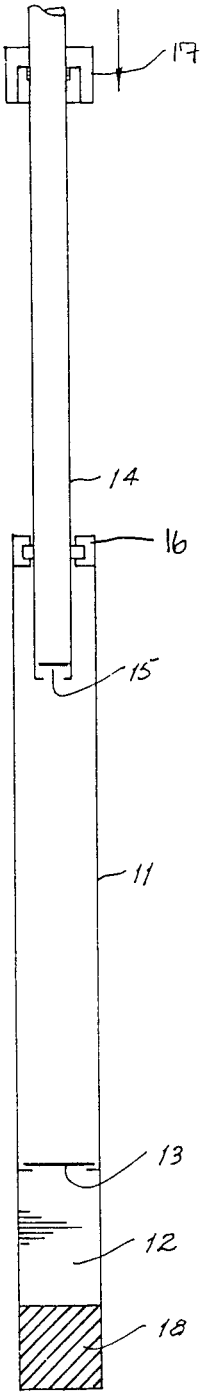

The first embodiment shown at FIGS. 1 and 2 relates to a bore hole lift pump which comprises a pump body 11 which is to be located at the lower end of a bore hole and has located at its lower end, an inlet closed by a one way foot valve 13. The inlet is associated with a screen or strainer 12 which serves to eliminate most of the solid particles carried in the water to be pumped. The lower end of the screen 12 is connected to a weighted anchor 18 which serves to assist in retaining the pump body 11 within the bore hole. The upper end of the pump body 11 slidably supports a riser pipe 14 which is supported in the bore hole from the top thereof to reciprocate within the bore hole and within the pump body 11. An annular seal 16 is mounted at the upper end of the pump body 11 to sealingly and slidably engage with the external walls on the riser pipe 14. Preferably the seal 16 takes the form of a lip seal whereby the lip is directed inwardly in relation to the pump body 11. If desired to protect the seal from any abrasive material a cover may be provided over the seal at the upper end of the pump body to be slidably received over the riser pipe 14. The lower end of the riser pipe 15 supports a second non-return valve 15 which permits the entry of water from within the pump body to within the riser pipe 14.

In operation when the riser pipe 14 is caused to move upwardly within the pump body 11 water is caused to be drawn into the pump body 11 through the one way foot valve 13. On movement of the riser pipe 14 downwardly within the pump body 11 and the one way foot valve 13 is closed while the one way lift valve 15 at the lower end of the riser pipe is caused to open to cause the flow of fluid into the riser pipe 14. With continued reciprocation of the riser pipe fluid is transferred into the pipe body 11 and then to the riser pipe 14 where it is caused to flow upwardly. To assist the drive in effecting movement of the riser pipe in its downstroke and in order to at least partially overcome the fluid friction induced during the flow of the fluid through the riser pipe 14, a weight 17 or suitable biassing means is provided on the riser pipe above the pump body 11. The weight may not be required if the weight of the pipe is sufficient and if the pipe is well guided.

As a result of the embodiment a bore hole lift pump is produced whereby friction is induced in the fluid flow only during the downstroke of the riser pipe during which time water is caused to enter the riser pipe. During this downstroke such frictional forces are at least partially overcome by the dead weight of the riser pipe 14 and the weight 17. During the upstroke of the riser pipe the main force to be overcome by the driving means effecting reciprocation in the riser pipe is that produced by the dead weight of the riser pipe and the weight of the water within the riser pipe. This weight of water is the same as that which would be induced in a conventional form of lift pump.

The avoidance of the need to provide a piston sealingly engaged with the walls of the pump body avoids each of the disadvantages referred to above the ensures that the only point of leakage of water from the riser pipe 14 is through the one way lift valve 15 which is less likely to suffer abrasion or malfunction as a result of use than the conventional piston seal.

The provision of the seal 15 between the pump body 11 and the riser pipe 14 at the upper end of the pump body 11 ensures that the seal is not being immersed in the fluid being pumped and the effect of any abrasive particles contained by the fluid being pumped and/or the corrosive nature of the fluid being pumped is minimised. Furthermore if such a seal could suffer any damage any fluid leakage from the pump body is unlikely to produce any delay between commencement of the pumping action and delivery of the pumping fluid or the need to prime the pump due to the presence of the non-return valve 15 at the lower end of the riser pipe 14. In addition if a lip seal is used as a seal 16 between the pump body 11 and the riser pipe 14 such that the lip seal is directed inwardly in relation to the pump body any abrasive particles that may gather in the region of the seal will be drawn into the pump body during the upstroke of the riser pipe due to the flow of liquid produced into the pump body 11 past the seal 16. During the downstroke of the riser pipe 14 the increase in pressure within the pump body will cause the lip seal to bear against the riser pipe 14 however the frictional forces so created are somewhat alleviated by the effect of the movement of the riser pipe in the direction of bias of the lip seal. Furthermore since the circumference of the riser pipe 14 is considerably less than that of the pump body 11 the area available for creation of the frictional force by the seal 16 is minimised in comparsion to that which would be created by a piston seal within the pump body 11. Furthermore as stated previously the production of the smooth exterior surface on a tube is more readily created than the smooth interior surface of a tube particularly where the tubes are formed by extrusion techniques and therefore it is not necessary for the exterior surface of the riser pipe 14 to be machined to provide for an adequate seal with the seal 16.

A further advantage offered by the embodiment resides in the reduced number of components which need to be provided due to the absence of a pull rod, guide or piston.

It may be preferable to provide guides around the riser pipe 14 at spaced locations along its length to ensure that the riser pipe remains substantially central within the bore hole during use and it may also be desirable to locate a guide a the lower end of the riser pipe 14 within the pump body 11 to ensure that the riser pipe remains substantially central within the pump body 11.

Figure 3:
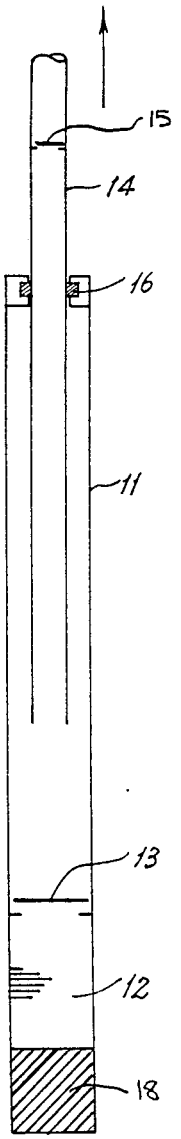
FIG. 3 is a schematic sectional elevation of a pump according to the second embodiment during the upstroke portion of the pump cycle.
Figure 4:
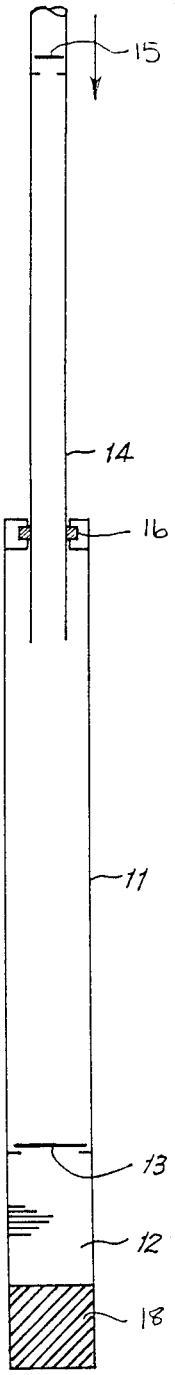
FIG. 4 is a schematic sectional elevation of a pump according to the second embodiment during the downstroke of the pump cycle.

The second embodiment as shown at FIGS. 3 and 4 is similar to the first embodiment and in the light of such the same reference numerals have been used in respect to corresponding components. The second embodiment differs from the first embodiment in that the one way lift valve 15 in the riser pipe 14 is located at a point spaced from the end of the riser pipe. The provision of the one way lift valve 15 in a portion of the riser pipe 14 which is clear of the pump body 11 enables the valve to be of a larger construction than the valve of the first embodiment. This feature serves to reduce the fluid friction caused by movement of fluid through the valve.

If desired the pump body 11 of the first and second embodiments may be associated with a clamping means capable of releasably retaining the body within the bore hole. Such means may be pneumatically or hydraulically or mechanically operated. In addition the pump of the first and second embodiments may be used in lined or unlined bore holes.

Figure 5:
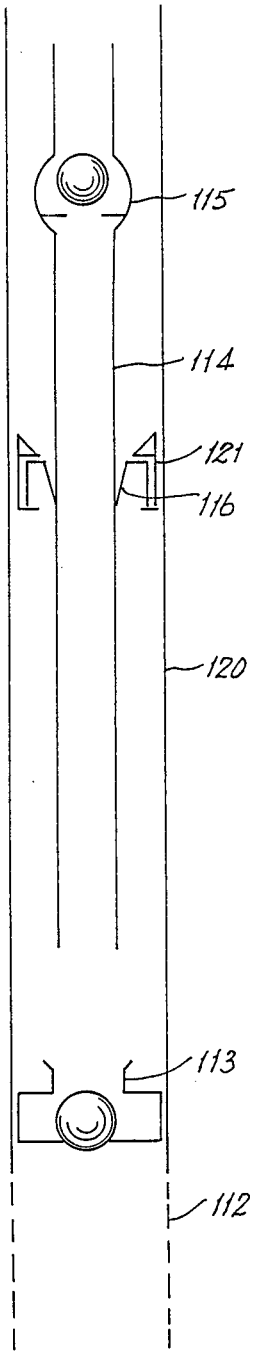
FIG. 5 is schematic sectional elevation of a third embodiment of the invention.

The third embodiment of FIG. 5 utilises a bore hole casing 120 as the pump body of the first and second embodiments whereby the casing 120 is located in the bore hole and a suitable screen 112 is located at the lower end of the casing. The lower end of the casing 120 supports a one way foot valve 113 which may be mounted to the lower end of the casing prior to the casing being located in the bore hole or alternatively may be lowered and fixed into the casing 120 subsequent to the bore hole casing being located in the bore hole. The casing 120 further supports a collar 121 at a point spaced above the one way foot valve 113 which may be located within the casing 120 before or after the casing is located in the bore hole. The collar 121 supports an inverted lip seal 116 whereby the lip of the seal is directed inwardly towards the one way foot valve 113. The collar 121 is formed with an upper edge which is inclined inwardly to provide a converging guide into the central portion of the collar 121. The pump of the third embodiment further comprises a riser pipe 114 which is slidably and sealably engaged by the lip seal 116 within the collar 121 and which supports a one way lift valve 115 at a point in the riser pipe which is spaced above the collar 121. The upper end of the riser pipe 114 is connected to a driving means which causes reciprocation of the riser pipe 114 within the casing 120. The result of the reciprocation of the lower end of the riser pipe 114 within the casing 120 between the foot valve 113 and the lip seal 116 causes the pumping of liquid upwardly through the riser pipe 114 past the fixed valve 115 in the manner described above in relation to the first and second embodiments. The lower end of the riser pipe 114 can be used to engaged the foot valve 113 when at its lowermost position in the barrel 111 to facilitate removal of the foot valve 113 and thus the seal 116 on extraction of the riser pipe 114.

The advantage offered by the third embodiment relates to the simplicity of its construction and installation and the resultant simplification of any maintainence procedures.

Figure 6:
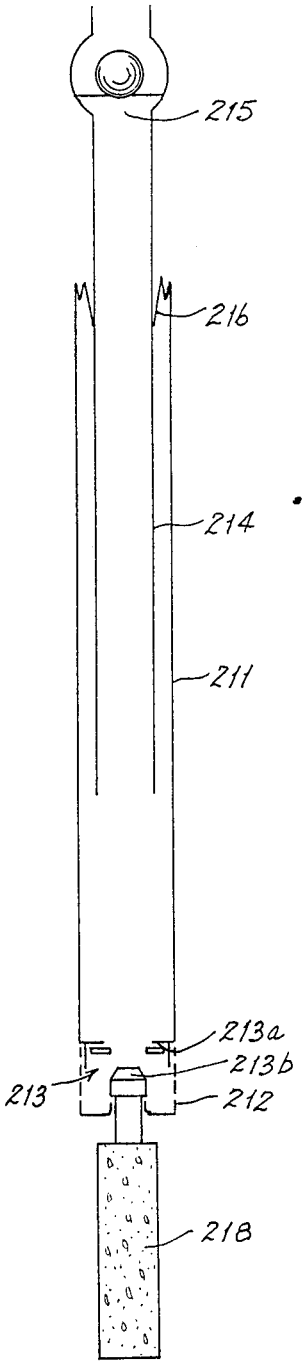
FIG. 6 is a schematic sectional elevation of the fourth embodiment of the invention.

The fourth embodiment of FIG. 6 is similar in principle to the previous embodiment and comprises a pump body 211 which is capable of limited axial movement within the bore hole. The lower end of the body is associated with a foot valve 213 which is formed by a valve seat 213*a* defined by an inwardly directed annular flange at the lower end of the body. The valve seat 213*a* is engageable with a fixed valve member 213*b* which extends upwardly from the base of the bore hole and is supported therein by an anchor 218. The lower end of the pump body 211 is associated with a strainer 212 which extends around the foot valve 213 and is slidable over the support for the valve member 213*b*. The upper end of the pump body 211 supports a seal 216 defined by an annular lip seal whereby the lip is directed inwardly in relation to the pump body 211. The seal 216 slidably and sealing receives the riser pipe 214 which is supported at its upper end by a driving means which effects reciprocation of the riser pipe 214 within the bore hore above the lower end of the riser pipe 214 within the pump body 211. As in the third embodiment of FIG. 5 the riser pipe supports a one way lift valve 215 at a point in the length of the riser pipe 214 above the seal 216. The area of the annular space between the riser pipe 214 and the internal bore of the pump body 211 is less than the area of the annular flange which defines the valve seat 213*a* of the foot valve 213.

In use as the riser pipe 214 is caused to move upwardly within the bore hole the reduction in pressure created within the pump body 211 as a result of such movement causes the pump body 211 to move upwardly within the bore hole such that the valve seat 213*a* moves clear of the valve member 213*b* allowing the flow of water into the pump body 211. On completion of the upward stroke of the riser pipe 214 and the commencement of the downstroke 214 the resultant increase in pressure within the pump body 211 increases the force upon the annular flange defining the valve seat 213*a* of the foot valve 213 which is greater than the upwardly directed force upon the seal 216. The resultant effect is that the pump body is caused to move downwardly to bring the valve seat 213*a* into sealing engagement with the valve member 213*b* and as a result water within the pump body 211 is caused to flow into the riser pipe 214 past the one way lift valve 215.

As a result of the embodiment a bore hole pump is produced whereby the riser pipe and pump body 211 may be extracted from the bore hole for servicing to leave the anchor 218 and valve member 213*b* within the bore hole. If desired the anchor 218 may be rendered removable from the bore to facilitate servicing of the valve member 213*b*. In addition if appropriate suitable guides may be provided between the exterior of the riser pipe 214 and the interior of the pump body 211 and between the exterior of the riser pipe 214 and the bore hole.

Figure 7:
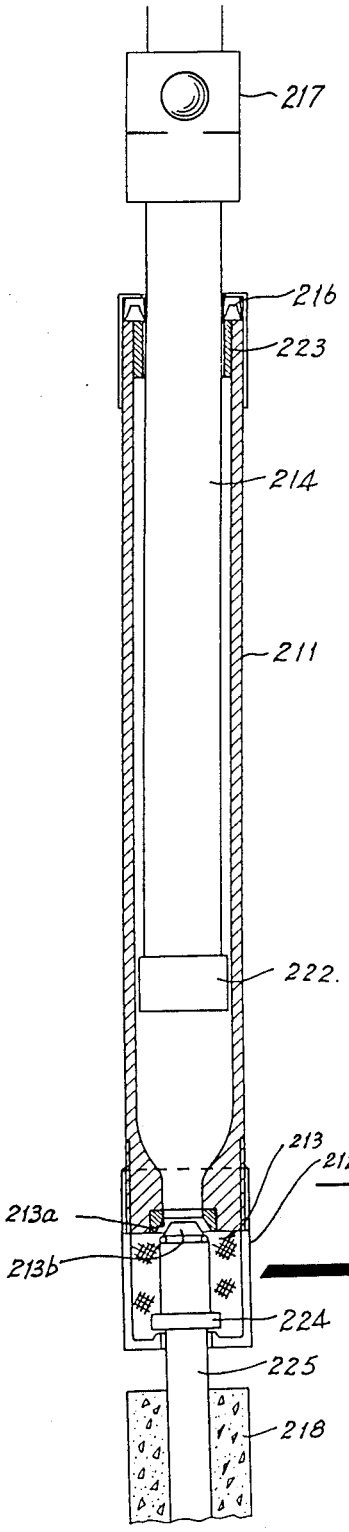
FIG. 7 is a schematic sectional elevation of a fifth embodiment.

The fifth embodiment shown at FIG. 7 is similar to the fourth embodiment of FIG. 6 and similar reference numerals have been used in respect of corresponding components. The significant difference of the fifth embodiment from the fourth embodiment relates to the provision of a collar 217 which accommodates the one way lift valve. The collar serves in engaging the top of the barrel at the lowermost position of the riser pipe 214 in the barrel 211. This feature enables the valve seat 213*a* to be driven down onto the valve member 213*b* to break up and clear any materials captured thereby which may prevent the closing of the valve.

In addition the lower end of the riser pipe 214 supports a lower collar member 222 which engages the seal housing 223 at the top of the barrel 211 at the uppermost position of the riser pipe 214 in the barrel 211. This feature facilitates extraction of the barrel 211 from the bore hole when the riser pipe is extracted. The supporting shank 225 for the valve member 213*b* is frictionally retained in the anchor 218 and has a rib 224 which can be engaged by the strainer 212 when the barrel 211 is lifted from the bore hole to enable the valve member 213*b* to be extracted.

If desired the valve member 213*b* may be fixed to the anchor 218 and the strainer 212 is retained on the valve member 213*a* by a resilient rib or like means which the strainer can be pulled over when the barrel 211 is extracted from the bore hole.

Figure 8:
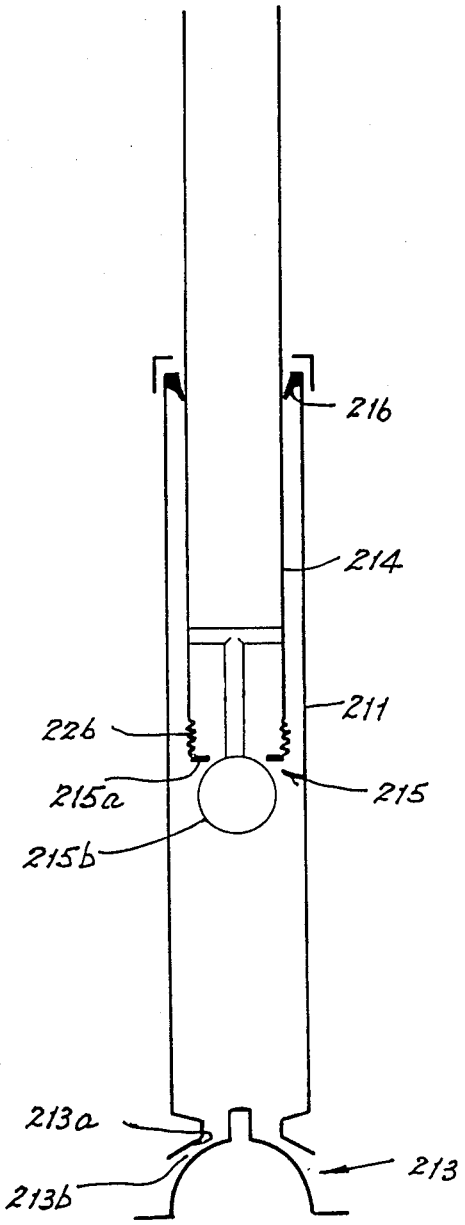
FIG. 8 is a schematic sectional elevation of a sixth embodiment.

The sixth embodiment shown at FIG. 8 is similar in form to the fourth and fifth embodiments of FIGS. 6 and 7 and similar reference numerals have been used in respect of corresponding components other than the configuration of the one way foot valve 213. The sixth embodiment includes a variation in the form of the one way lift valve 215. The lift valve 215 comprises a fixed valve member 215*b* which is suspended from the end of the riser pipe and is engaged by a valve seat 215*a* which is supported from the lower end of the riser pipe 214 by a flexible coupling 226. As the riser pipe is lifted the flexible coupling 226 extends to allow the valve seat 215*a* to engage with the valve member 215*b*. As the riser pipe descends the flexible coupling 226 will contract to allow the valve seat 215*a* to lift from the valve member 215*b*.

Figure 9:
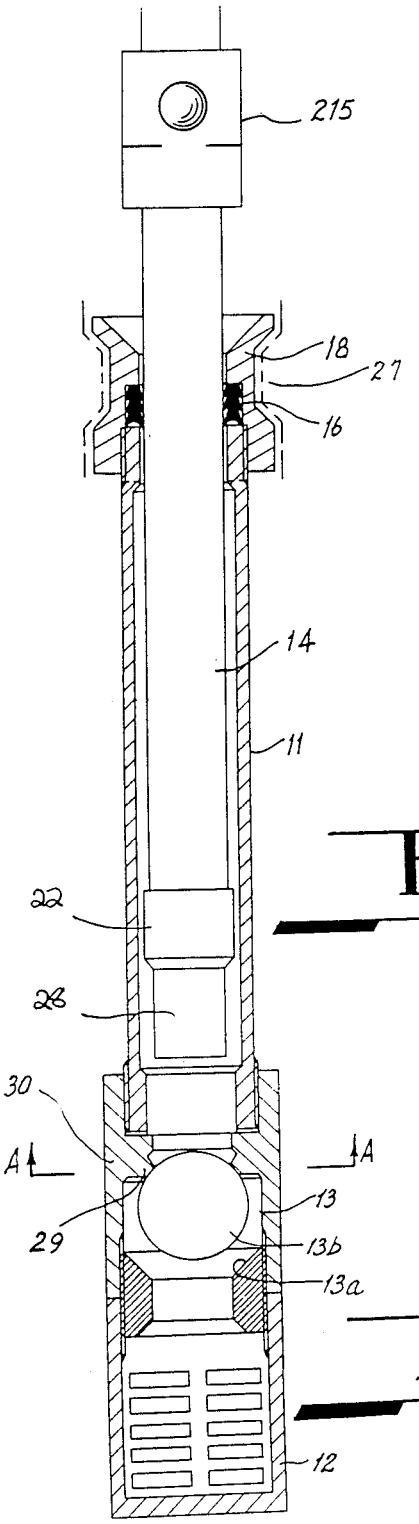
FIG. 9 is a schematic sectional elevation of a seventh embodiment.
Figure 10:
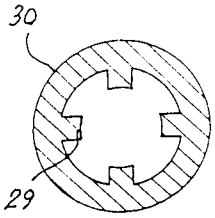
FIG. 10 is a sectional view along line A—A of FIG. 9.

The seventh embodiment shown at FIG. 9 is similar to the first and second embodiments of FIGS. 1–4 and similar reference numerals have been used for corresponding components.

The seventh embodiment differs from the first and second embodiment in the form of anchor 18 which comprises a clamping collar mounted to the upper end of the barrel and which is engagable with a corresponding abutment 27 on the bore casing. In addition the anchor 18 houses the seal 16 which takes the form of a multiple lip seal.

As in the fifth embodiment the seventh embodiment has a first collar which accommodates the one way lift valve on the riser pipe 14 which engages the upper end of the barrel 11 at the lowermost position of the riser pipe 14 in the barrel 11. The lower end of the riser pipe 11 also supports a second collar 22 which will engage with the lower end of the barrel 11 at the lowermost position of the riser pipe 14 in the barrel 11. The second collar 22 facilitates extraction of the barrel 11 from the bore hole when the riser pipe 14 is extracted. Beyond the second collar 22 the riser pipe is formed with an extension piece 28 which will extend into the one way foot valve 13 to drive the valve member 13*b* against the valve seat 13*a* when the riser pipe is at its lower position in the barrel. This enables any foreign matter between the valve member and valve seat to be broken up and cleared from the foot valve 13 if present.

The valve member 13*b* is retained in the region of the valve seat by inwardly extending lugs 29 located around the interior of the valve body 30 above the valve seat 13*a*.

It should be appreciated that in the fifth and seventh embodiments the lowermost position of the riser pipe in the barrel referred to is not usually attained during normal pumping operations but is only attained when it is necessary to clear the foot valve of foreign matters.

In summary, the advantages offered by the pumps of each of the embodiments described above over those pumps which utilise a reciprocating piston within the cylinder bore may be summarised as follows:

1. A seal between the pump body and the reciprocating riser pipe is uppermost in the pump body and is not positioned in the main fluid flow. Therefore the possibility of sand and grit being captured by the seal and substantially reduced. Furthermore any grit which finds its way into the seal should tend to move out from the seal due to fluid flow past the seal.
2. The number of components is minimised since there is no pull rod or pull rod guides.
3. Flow friction is minimised for a given riser pipe diameter due to the absence of a pull rod within the riser pipe.
4. The sliding seal surface is external to the plunger rod which facilitates the provision of a smooth surface.
5. The previous feature provides the possibility of a longer pumping stroke which offers increased pump efficiency.
6. The pump body and riser pipe are readily extracted from the bore hole for maintanence and inspection.
7. The work done per cycle is split into two components:
   (i) bore water lifting is performed on the upward stroke;
   (ii) flow friction, plus flow work above ground, are together overcome on the downstroke. This facilitates a more convenient match to the output of a simplex vapour expander or its equivalent. The piston expander usually delivers greater force at the begining of its stroke then towards the end. This is not well matched to a steady resistance provided by the usual water pumping action. With the pump of each of the embodiments the expander is overcoming only dead weight and inertia. It can therefore be designed to efficiently apply the greater force to overcome inertia and produce upward acceleration of the water column and dead weight. Thus good coupling may be achieved.
8. The design is appropriate for the use of plastics materials (e.g. PVC) with the resultant reduction in cost and corrosion.
9. The pump is able to be used in bore holes having a smaller diameter than is currently the situation.
10. Due to the absence of a seal between relative reciprocating surfaces which is also required to retain fluid in the riser pipe the possibility of leakage from the riser pipe back into the pump body is significantly reduced thus eliminating the need for priming and/or any excessive delay between the recommencement of the pumping action and the delivery of fluid.
11. The pump is robust since the only points of failure other than the one way valves and the seals relates to the interconnection of the valves to the barrel and riser pipe and the lengths of pipe which make up the riser pipe.
12. It is possible to operate on the foot valve when installed to clear that valve of debris or the like.

In order to drive the pumps of any of the embodiments described above any reciprocatory drive may be used. It is envisaged that the pumps described in each of the embodiments may be particularly applicable to hand pumping situations.

It should be appreciated that the scope of the present invention need not be limited to the particular scope of the embodiments described above. In particular the invention need not be restricted to bore hole pumps only. It may be used in any other pumping situation.

The claims defining the invention are as follows:

1. A pump of the type adapted to be lowered into a body of fluid for pumping fluid therefrom comprising a pipe having an open lower end and an upper discharge end for discharging pumped fluid from a point above the body of fluid, said pipe being reciprocal through a normal pumping stroke, first check valve means for permitting flow into said pipe through said open lower end, a hollow body slidably supported upon the lower end of said pipe and defining a cavity into which said open lower pipe end extends, seal means interposed between an upper end of said hollow body and said pipe for sealing the upper end of said cavity, said hollow body having not portion that is engaged by said pipe upon normal pumping reciprocating of said pipe so that said hollow body is not physically reciprocated by contact with said pipe upon normal pumping reciprocation of said pipe, an opening formed at the lower end of said hollow body, and a second check valve for controlling the flow through said hollow body opening for permitting flow into said hollow body cavity and for precluding flow out of said opening, said second check valve comprising a first element fixed relative to said hollow body and a cooperating second element adapted to be fixed relative to the body of fluid, and said pipe being reciprocated between a raised position and a lowered position during the normal pumping reciprocation thereof, the reciprocation of said pipe into said raised position effecting a pressure difference upon said hollow body by the fluid in the fluid body for moving the first element of said second check valve away from the second element of said second check valve for permitting flow of fluid into said hollow body cavity solely due to fluid pressure variations, movement of said pipe in a downward direction being effective to permit said hollow body to move for bringing said first element into sealing engagement with second element for pressurizing the fluid in said hollow body cavity for driving said fluid upwardly through said first check valve into said pipe and be discharged through said upper discharge end.

2. A pump as claimed at claim 1 wherein the innermost configuration of the hollow body is such that on the fluid pressure within the hollow body increasing the resultant force created thereby causes the fixed element of the hollow body to move into engagement with the cooperating second element.

3. A pump as claimed at claim 1 wherein the pump comprises a water lift pump.

4. A pump as claimed at claim 1 wherein said first check valve comprises a valve member fixed to said pipe and a valve seat fixed from said pipe with an extensible coupling in the pipe between the fixing for the valve seat and the valve member whereby said valve member will seal with the valve seat on a positive pressure differential existing in the interior of the pipe remote from the hollow body through extension of the coupling.

5. A pump as claimed at claim 1 further including a strainer affixed to the lower end of the hollow body and encircling the second check valve, said strainer being associated with said second valve element for lifting said second valve element upon lifting of the pipe above the raised position.

6. A pump as claimed at claim 1 wherein the hollow body is tubular.

7. A pump as claimed at claim 6 wherein the hollow body supports the second check valve at one end of said hollow body and the seal at the other end of said hollow body.

8. A pump as claimed at claim 1 wherein the seal comprises a lip seal, the lip of which is directed inwardly in relation to the hollow body.

9. A pump as claimed at claim 8 wherein the seal comprises a multiple lip seal.

10. A pump as claimed at claim 1 wherein means carried by the pipe engages the hollow body when the pipe is moved beyond the lowered position to drive the first valve element into engagement with the second valve element.

11. A pump as claimed at claim 10 wherein the means carried by the pipe which engages the hollow body beyond the lowest position of the pipe comprises a valve housing containing the first check valve element.

12. A pump as claimed at claim 1 wherein the portion of the pipe accommodated within the hollow body is formed with a collar which is engagable with the hollow body on the pipe being raised above the raised position for raising the hollow body.

13. A pump as claimed as claim 12 further including a strainer affixed to the lower end of the hollow body and encircling the second check valve, said strainer being associated with said second valve element for lifting said second valve element upon lifting of the pipe above the raised position.

* * * * *

UNITED STATES PATENT AND TRADEMARK OFFICE

CERTIFICATE OF CORRECTION

PATENT NO. : 4,762,474

DATED : August 9, 1988

INVENTOR(S) : William J. Dartnall

It is certified that error appears in the above-identified patent and that said Letters Patent is hereby corrected as shown below:

Column 1, line 15, delete "the".

Column 3, line 24, "the" (second occurrence) should be --and--.

Column 3, line 29, "15" should be --16--.

Column 5, line 17, "hore" should be --hole--.

Column 8, line 16, claim 1, "not" should be --no--.

Column 8, line 17, claim 1, "reciprocating" should be --reciprocation--.

Column 10, line 10, claim 13, "as" (second occurrence) should be --at--.

Signed and Sealed this

Sixth Day of June, 1989

*Attest:*

*Attesting Officer*

DONALD J. QUIGG

*Commissioner of Patents and Trademarks*